US005515625A

United States Patent [19]

Keigley

[11] Patent Number: 5,515,625

[45] Date of Patent: May 14, 1996

[54] RAKE ATTACHMENT WITH SCARIFYING TEETH FOR A SKID STEER

[75] Inventor: Kevin V. Keigley, Osceola, Ind.

[73] Assignee: Hydroseed Manufacturing, Incorporated, Osceola, Ind.

[21] Appl. No.: 275,108

[22] Filed: Jul. 14, 1994

Related U.S. Application Data

[63] Continuation-in-part of Ser. No. 102,207, Aug. 5, 1993, Pat. No. 5,413,181.

[51] Int. Cl.[6] ..... F02F 3/76

[52] U.S. Cl. ..... 37/405; 172/253; 172/445.1; 414/724

[58] Field of Search ..... 37/301, 302, 403, 37/404, 405, 409, 410, 903; 56/400.04, 400.06; 172/197, 253, 200, 445.1, 684.5, 685, 713, 714, 759, 766, 770, 777

[56] References Cited

U.S. PATENT DOCUMENTS

| | | | |
|---|---|---|---|
| 2,081,192 | 5/1937 | Allin et al. | 172/777 X |
| 2,446,074 | 7/1948 | Blackmore | 172/777 |
| 3,034,237 | 5/1962 | Wolfe et al. | 37/405 |
| 3,163,945 | 1/1965 | Dooley | 172/777 X |
| 3,834,567 | 9/1974 | Miller | 37/405 X |
| 4,125,952 | 11/1978 | Jennings | 37/405 |
| 4,407,080 | 10/1983 | Mann | 37/409 X |
| 4,669,947 | 6/1987 | Frost | 37/903 X |
| 4,692,089 | 9/1987 | Rodgers et al. | 37/903 X |
| 4,886,124 | 12/1989 | Kleinbuizen | 172/445.1 |
| 5,413,181 | 5/1995 | Keigley | 172/253 |

*Primary Examiner*—Randolph A. Reese
*Assistant Examiner*—Robert Pezzuto
*Attorney, Agent, or Firm*—Baker & Daniels

[57] ABSTRACT

A rake attachment for use on a skid steer, which can be used for multiple lawn and grounds preparation activities, such as grading, filling, leveling and scarifying. The rake attachment of this invention combines several useful attachment functions into a single compact design. The rake attachment includes a support frame that has spaced side support members to define an opening through which a skid steer operator may view the soil being worked. Scarifying teeth extend from the support frame to penetrate the ground for scarifying. The support frame includes tines which work and level the soil as it is being scarified by the scarifying teeth.

10 Claims, 6 Drawing Sheets

4
2
5
10
11
6
20
17
16
14
32
34
70
25
24
26
50
22
56
30
39
40
8

4
2
5
10
20
16
14
17
32
25
34
22
24
26
50
56
70
30
39
40
8

4
2
5
10
20
22
26
25
32
50
24
17
34
11
56
39
16
8
30
70
40
14

4
2
10
5
20
17
16
11
14
40
34
39
32
30
24
26
25
56
22
70
8
50

RAKE ATTACHMENT WITH SCARIFYING TEETH FOR A SKID STEER

This is a continuation in part of U.S. patent application Ser. No. 102,207, filed Aug. 5, 1993, now U.S. Pat. No. 5,413,181.

This invention relates to a rake attachment with scarifying teeth for a skid steer loader.

BACKGROUND OF THE INVENTION

Grounds preparation for seeding and lawn installation is a part of most building and construction projects. Preparing soil for seeding and lawn installation involves grading, filling, leveling and scarifying the soil around buildings, side walks, trees and other obstacles. Conventional industrial and commercial earth moving equipment is designed to operate in large open areas, thus they are not well suited for operation in confined areas or around the edges of buildings and other structures. Consequently, most of the finishing work around buildings and confined areas is still performed by laborers with hand tools. Utilizing conventional skid loaders or skid steers as they are commonly known has decreased the amount of hand work involved in lawn and grounds preparation. As a small utility loader, the skid steer is well adapted for precision earth moving operations in confined areas. Skid steers have hydrostatic transmissions with four independent wheels, which allows the skid steers to pivot in place. Skid steers also include hydraulic controlled lift arms and pivoting attachment assembly, which can be operated simultaneously while driving skid steers.

A skid steer can be fitted with various attachments to perform a variety of earth moving functions; however, no single skid steer attachment has been developed to address all the operational needs of the lawn or grounds preparation industry. Bucket attachments are ideal for transporting loads of soil to low lying areas, but are ill suited for spreading the soil radially across the low lying area. The conventional blade type attachment allows the skid steer to grade but does not drag soil or scarify effectively. The bulk of conventional buckets and blade type attachments obstruct the operators view of the ground being worked. Mechanical scarifying rakes have been developed for use with skid steers; however, these scarifying rakes have complex mechanical parts, which are often subjected to stress, which results in damage and often failure. The articulated mechanical scarifying rakes are large and cumbersome, which makes them difficult to operate in confined areas, such as around building and other obstacles. The operator's view of the ground being worked is obstructed by the bulk of the mechanical attachments. Furthermore, the scarifying rakes are ineffective at moving soil to low lying areas. Since no single attachment is suitable for all the lawn preparation functions; namely grading, filling, leveling, scarifying and vegetation removal the skid steer attachments must be frequently interchanged during use at the job site. Transporting multiple attachments is cost ineffective.

SUMMARY OF THE INVENTION

The rake attachment of this invention allows a conventional skid steer to be used for all lawn preparation functions: grading, filling, leveling and scarifying. The design of the rake attachment allows the skid steer to push as well as pull soil. Consequently, the rake attachment can be used to grade soil off of high areas, to push soil into low areas, and to scarify the soil to a seeding ready finish. The rake attachment eliminates the mechanical complexity of other attachments and the inconvenience of frequently changing attachments to perform various earth moving functions. The design of the rake attachment also maximizes the operator's field of vision for precision operation around buildings and other confined areas.

This rake attachment includes a frame and a replaceable elongated toothed rake blade having a row of rigid spaced teeth along its forward edge. The frame includes a mounting plate for connecting the frame to the pivot plate of the skid loader and a forward lateral support member connected by a pair of spaced side members. The rake blade is mounted to the forward support member. The positioning of the rake blade and the open configuration of the frame provide the operator an unobstructed view of the ground being worked.

The rake attachment of FIGS. 8–12, in addition to the elongated frame with spaced tines, further includes a plurality of longitudely spaced ground penetrating scarifying teeth that extend from the frame at a ground engaging angle that forms substantially a right angle from the tines comprising the rake blade. The scarifying teeth permit deep penetration and scarifying of the earth while still permitting the tines comprising the rake blade to level and work the soil. The scarifying teeth may be removed from the support member and stored when scarifying is not desired.

Accordingly, an object of this invention is to provide for a novel and unique multi-purpose rake attachment for use with a skid steer loader.

Another object is to provide a rake attachment for a skid steer, which is suitable for pushing and pulling soil during grading, filling, leveling, scarifying and vegetation removal.

Another object is to provide for a low maintenance rake attachment for a skid steer, which reduces the complexity and number of components and allows a clear line of vision to the ground being worked.

Another object is to provide for deeply scarifying the soil while at the same time permitting the soil to be smoothed and worked.

Still another object is to permit scarifying teeth to be attached to the rake for deeply scarifying soil, but permitting such scarifying teeth to be removed when scarifying is not necessary.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed herein. It is chosen and described to explain the principles of the invention and its application and practical use to enable others skilled in the art to utilize its teachings.

FIGS. 1–7 show the rake attachment 20 of this invention used with a conventional skid loader or skid steer 2. Rake attachment 20 is shown used on a skid steer 2 manufactured by Melroe Company under the trademark "BOBCAT" although rake attachment 2 can be adapted for use with any make or model of skid steer.

Figure 7:
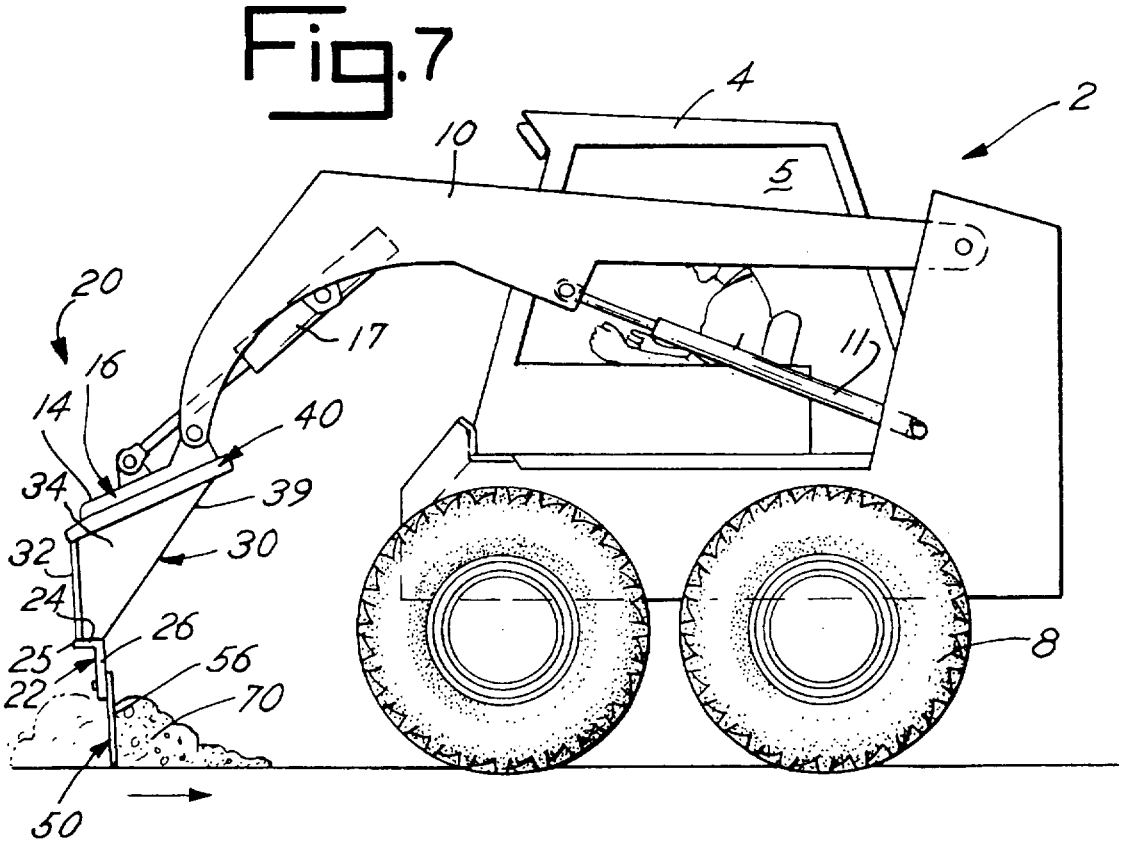
FIG. 7 is a side elevation view of the skid steer with the rake attachment dragging soil in a push/pull position and for vegetation removal.
Figure 8:
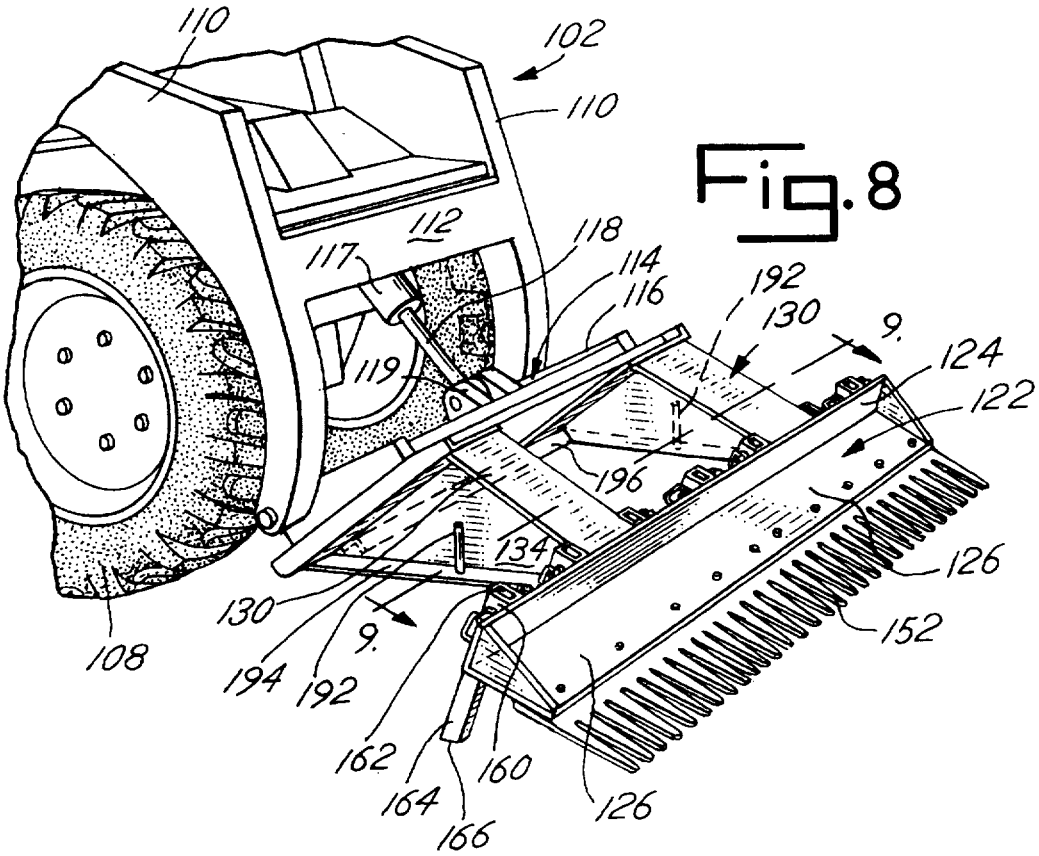
FIG. 8 is a fragmentary perspective view of a skid steer with a rake attached thereto pursuant to another embodiment of the invention.
Figure 9:
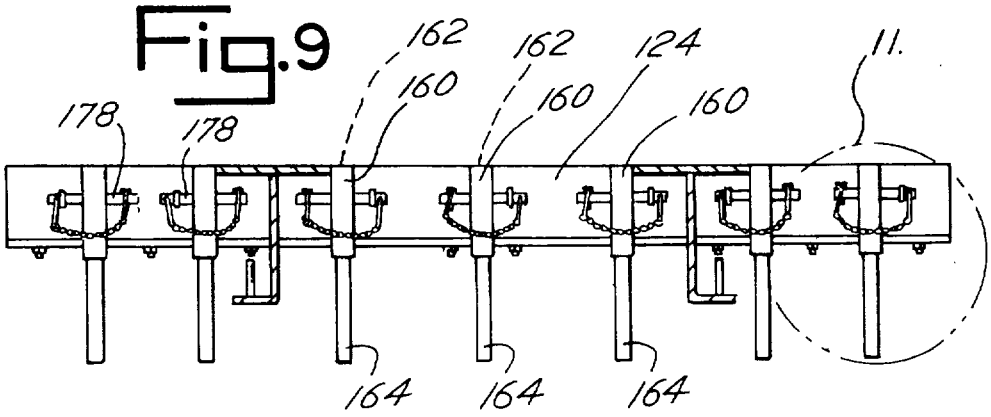
FIG. 9 is a cross-sectional view taken substantially along lines 9—9 FIG. 8.

Skid steer 2 includes a chassis 4, which has an operator's compartment 5. Skid steer 2 preferably uses the conventional hydrostatic transmission with four independently driven wheels 8. The transmission is operated by two steering hand levers 6. Chassis 4 supports two pivotal lift booms or arms 10, which are raised and lowered by a pair of hydraulic lift cylinders 11. Lift arms 10 are pivoted about a horizontal axis between a raised position (FIG. 4) and a lowered position (FIG. 5). A cross brace 12 connects arms 10 in front of operator compartment 5. A pivot assembly 14 is pivotally mounted to the front end of lift arms 10. Pivot assembly 14 includes a pivoting mounting plate 16, which carries an attachment connecting mechanism (not shown). A pivot cylinder 17 has its extensible rod 18 connected between mounting plate 16 and cross member 12 as by clevis 19. Pivot cylinder 17 shifts mounting plate 16 about a second horizontal axis between an up position (FIG. 4) and a down position (FIG. 5). As shown in FIG. 7, mounting plate 16 is substantially vertical when the lift arms 10 are in the lowered position and rod 18 is retracted. Mounting plate 16 is angled with respect to the horizontal when lift arms 10 are in the lowered position and rod 18 is extended out from cylinder 17. The lift and pivot cylinders are operated by two foot pedals (not shown) located within the operator compartment. As commonly known but not shown in the figures, mounting plate 16 carries a locking mechanism, which locks the various attachments to the mounting plate. The locking mechanism is not shown or described in detail and any conventional mounting mechanism can be used to secure the rake attachment of this invention to mounting plate 16.

As common in conventional skid steers, skid steer 2 can be operated in a float mode, wherein lift cylinders 11 are disabled to allow lift arms 10 to rest in a lowered position under their own weight and supported by chassis 4. Consequently, no additional downward force is introduced by lift cylinders 11. In the float mode, only the pivot cylinder 17 is operative, thereby reducing the number of operation controls to occupy the operator's attention. Rake attachment 20 is designed to take full advantage of this feature during finishing operations as detailed later in this specification.

Figure 2:
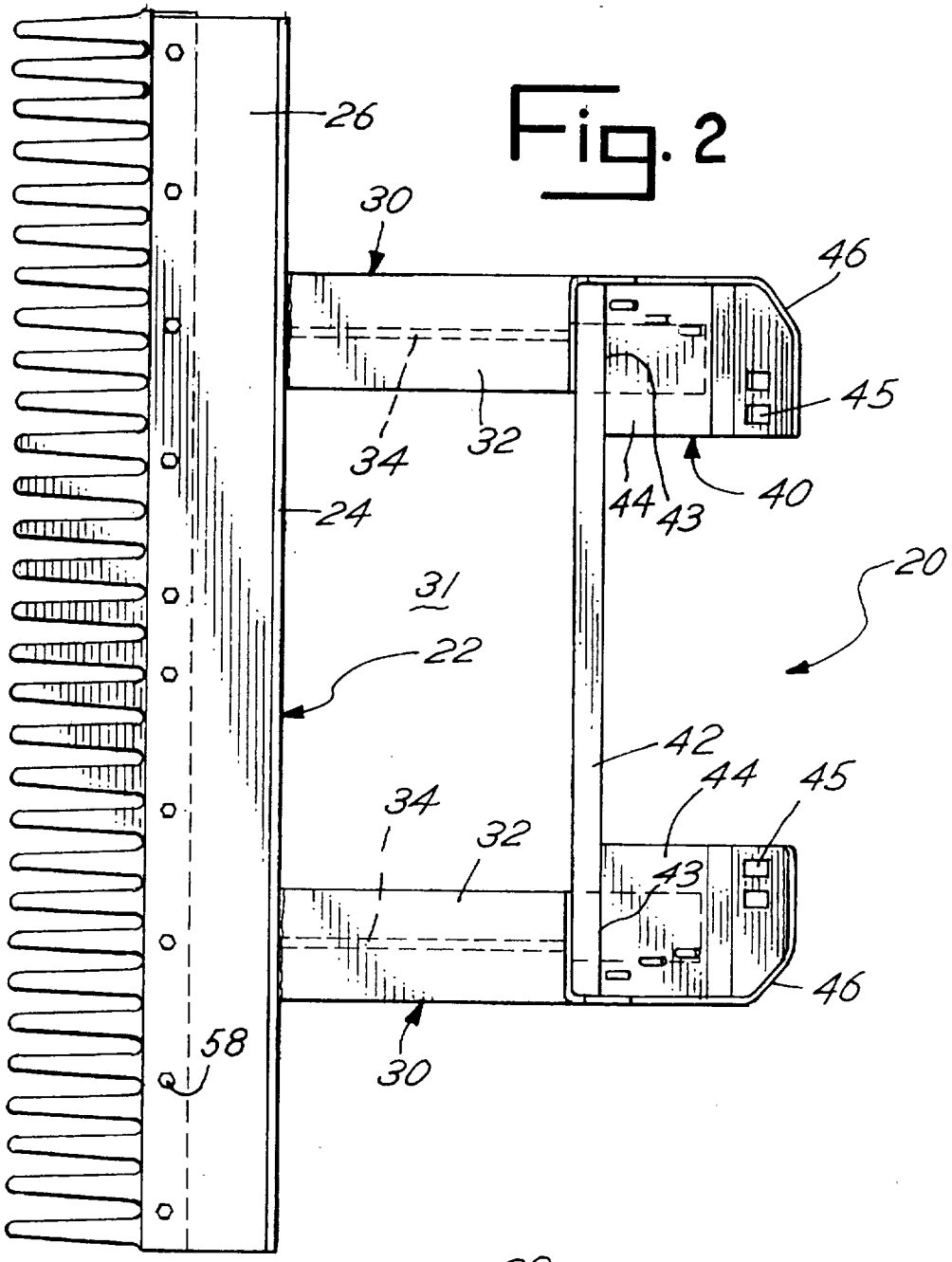
FIG. 2 is a top plan view of the rake attachment.
Figure 3:
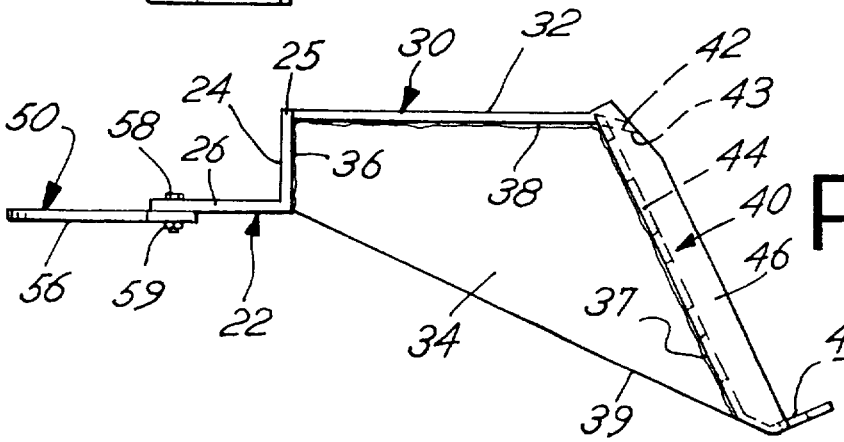
FIG. 3 is a side elevation view of the rake attachment.

As shown in FIGS. 2 and 3, rake attachment 20 includes a forward support member 22 connect to a mounting saddle 40 by a pair of spaced side support members 30. Forward support member 22 is preferably an elongated L-shaped angle bar with a lower forward side 26 and a raised back 24. Forward support back 24 is preferably of sufficient height to prevent loosened soil from kicking over the upper edge 25 of forward support member 22, while not substantially impairing the operator's line of sight to the rake blade 50.

Mounting saddle 40 is of conventional design and can adapted for connection to any type of mounting plate 16. Mounting saddles 40 are standardized for various models of skid steers 2 to accommodate various attachments. Mounting saddle 40 includes a pair of connection plates 44 connected by a cross member 42. Cross member 42 forms a down turned upper lip 43. Each connection plate 44 has a plurality of mounting holes 45. Each connection plate 44 also includes a rearwardly extending peripheral ridge 46 along the outer lower edges, which conforms to the contour of mounting plate 16. During the mounting process of rake attachment 20 to skid steer 2, ridge 46 serves to align mounting saddle 40 with mounting plate 16. As shown best in FIG. 1, the upper lip 43 engages the upper edge of mounting plate 16. The back surface of mounting saddle 40 rests flat against the front surface of mounting plate 16. Mounting saddle 40 is then locked into place against mounting plate 16 by the skid steer's locking mechanism (not shown) carried on mounting plate 16.

Figure 1:
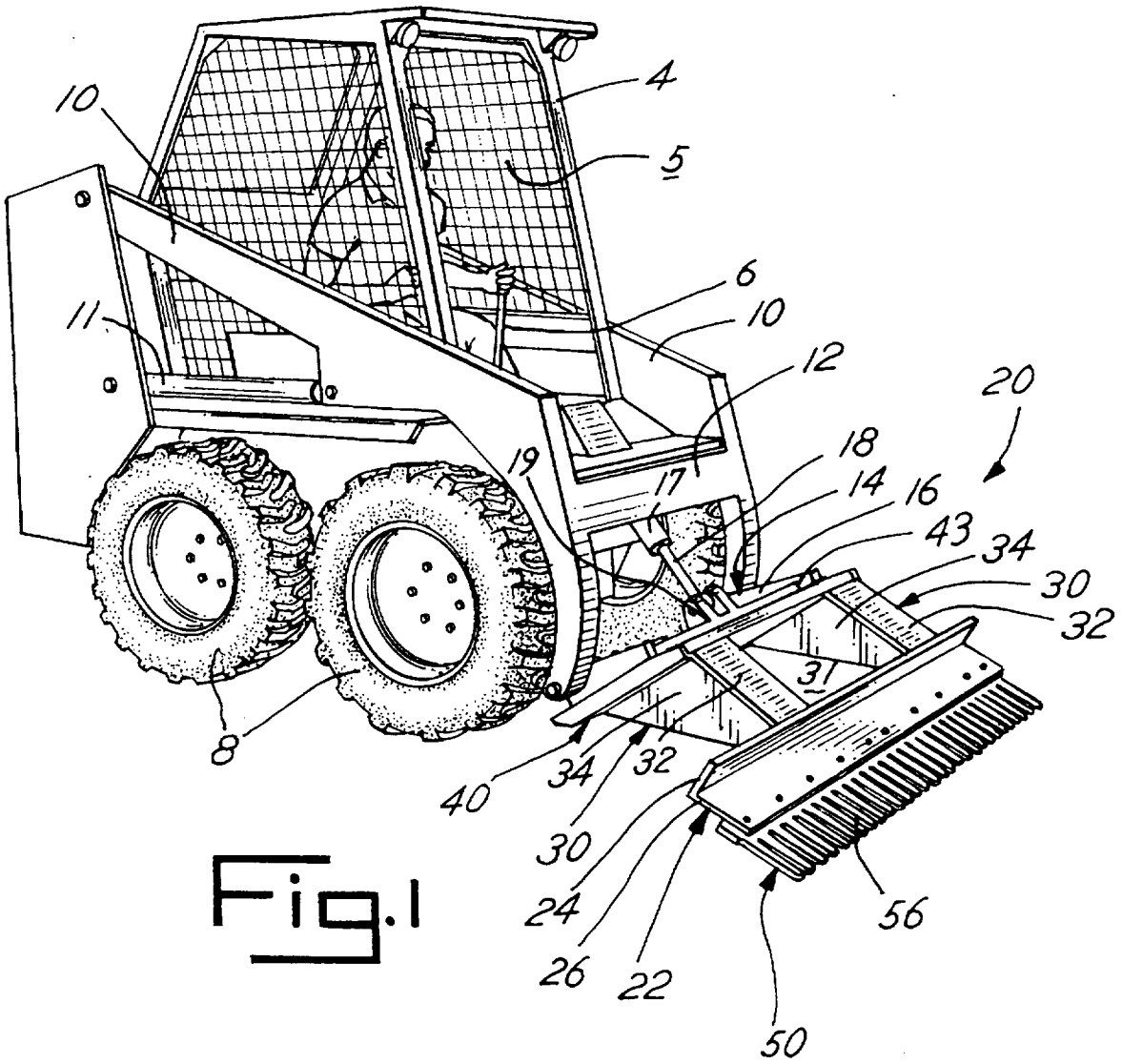
FIG. 1 is a perspective view of a skid steer with the rake attachment of this invention.

As shown in FIGS. 1–3, side support members 30 are spaced apart to define a central opening 31. Each side support member 30 includes a upper extension part 32 and a lower side gussets 34 centrally connected to its upper extension part. Upper extension parts 32 are connected between the upper edge 25 of forward support back 24 and the upper edges of each connection plate 44. Each side gusset 34 has four side edges 36–39, which define a substantially triangular configuration with a truncated forward fourth side. Each truncated forward edge 36 is connected as by welds to the rear face of forward support back 31. The opposite rear edges 37 are connected as by welding to the front face of each connection plate 44. The upper edges 38 are connected as by welding to the bottom of each upper extension members 34. The lower edged 39 extend diagonally between the lower edge of the support back 31 and the lower edges of each connection plate 44.

As shown in FIGS. 2 and 3, rake attachment 20 includes an elongated tined or toothed rake blade 50 connected to a frame 30 as by fasteners 58, 59. Rake blade 50 is mounted to the bottom face of forward support member 22. Rake blade 50 is defined by interconnected rectangular panel sections 52. Each panel section 52 is bolted to rake support member 22 by bolts 58, which extend through aligned bores in panel sections 52 and lower forward side 26, and nut fasteners 59, which are affixed to bolts 58. Rake sections 52 are connected to forward support member 30 in this fashion to allow ready replacement of individual panel sections. Each panel section 52 is of flat rectangular shape with a serrated forward edge, which forms a plurality of elongated tines or teeth 56. Panel sections 52 are cut or cast from any durable and rigid metal, such as iron or steel. Panel sections 52 are preferably hardened to provide additional tensile strength. Teeth 56 are straight and rigid to allow the teeth to bite into hard soil without bending or breaking and withstand the drag force exerted by the motion of the skid steer and the weight of lift arms 10. The contour and spacing of teeth 56 prevent rocks, foliage and other debit material from collecting between the teeth, which is common in drags and other attachments with coiled tines.

As seen in the figures, rake attachment 20 has a relatively small and compact design, which allows skid steer 2 to manipulate in tight areas. Rake attachment 20 uses no moving parts to effect all operational aspects, which enhances its valve in field operations. Furthermore, the design rake attachment 20 is easy to store or transport when detached from the skid steer 2.

Rake attachment 20 is designed to take advantage of the float mode operation of skid steer 2. Rake attachment 20 is fully operational without the assistance of the lift cylinders 11. Operation of the skid steer 2 in the float mode allows the operator to manipulate rake attachment 20 through all of its operational positions using only the pivot control foot pedal. Consequently, the operation of the rake attachment and skid steer is simplified. Using only the pivot control pedal to perform the ground work simplifies the task of the operator and avoids confusion between the lift and pivot control pedals. Since rake attachment 20 can operate solely with pivot cylinder 17, its operation is less taxing on the skid steer's hydraulic systems, which translates into increased performance and life span of skid steer 2.

Figure 4:
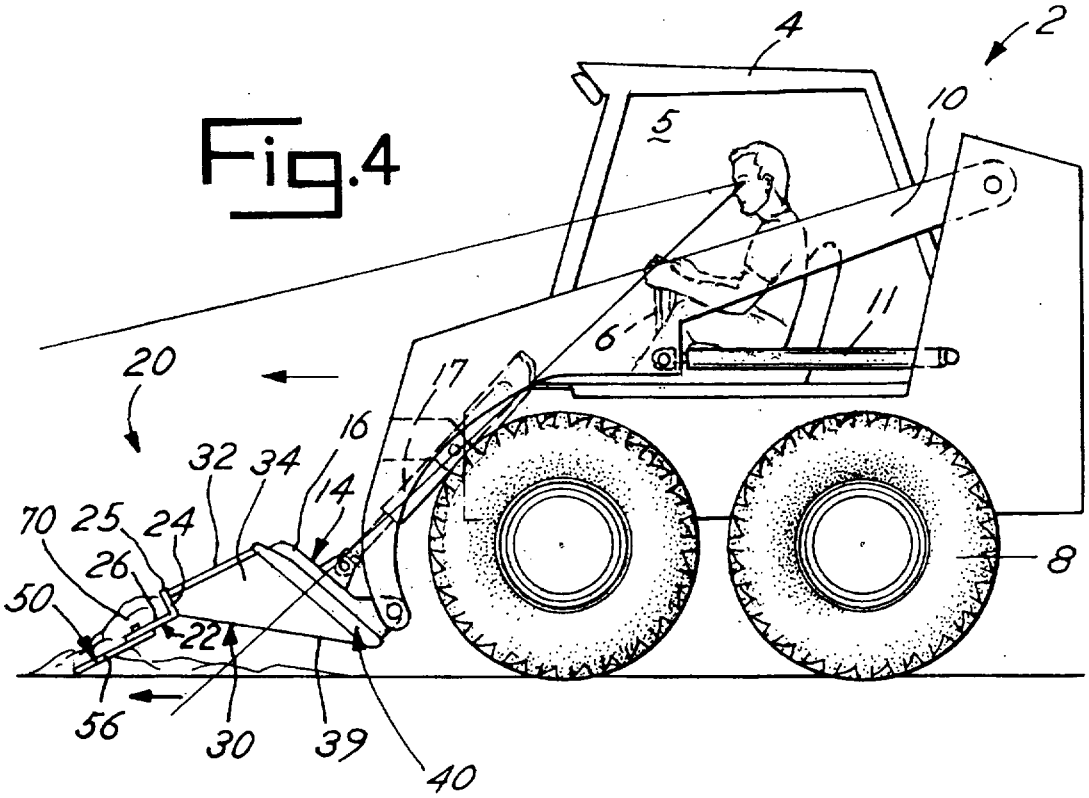
FIG. 4 is a side elevation view of the skid steer with the rake attachment in an elevated position above a pile of soil.
Figure 5:
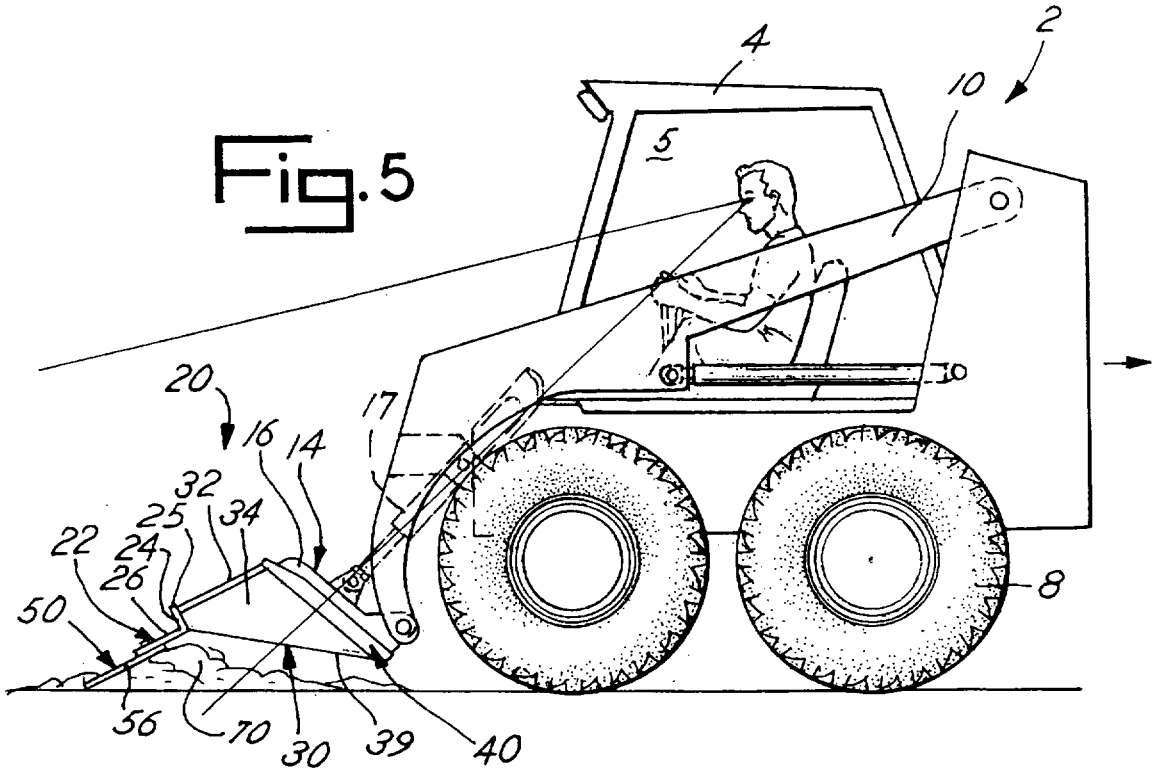
FIG. 5 is a side elevation view of the skid steer with the rake attachment performing a searifying operation.

FIG. 4 shows skid steer 2 with rake attachment 20 in the elevated position. In the elevated position, pivot cylinder 17 draws mounting plate 16 back towards skid steer 2, so that mounting plate 16 is substantially vertical and perpendicular to the ground. In the elevated position, rake blade 50 is spaced two to three feet above the ground and approximately three feet from the bottom edge of mounting plate 16. The lower diagonal edges 39 of side gussets 34 are slanted upward at approximately a 55 degree angle to the ground. The upward slant of lower diagonal edges 39 provides front end clearance, so that skid steer 2 can be positioned adjacent to small piles of earth with teeth 56 extend over the top of a pile of soil 70, as shown in FIG. 4. In the elevated position, the operator has a clear view of the worked ground and soil 70 around side support members 30 and though central opening 31.

FIG. 5 shows skid steer 2 with rake attachment 20 in the lowered or scarifying position. In the scarifying position, pivot cylinder 17 fully extends mounting plate 16 so that mounting plate 16 is pivoted beyond horizontal and rake blade 50 engages the ground perpendicularly. The rotation of mounting plate 16 and the connected rake attachment 20 to the scarifying position forces lift arms 10 to be raised slightly from their lowered position. The weight of lift arms 10 and the vertical position of rake blade 50, provides an ideal position for scarifying soil. Under the influence of gravity, the weight of lift arms 10 is transferred directly through rake blade 50. The combined weight of lift arms 10 and rake attachment 20 embeds teeth 56 into the soil and scars the soil as the skid steer moves backward. In scarifying position, lift arms 10 and mounting plate 16 are substantial horizontal and provide a clear unobstructed view of the entire rake blade 50. Consequently, the operator can directly monitor the depth and effectiveness of each skid steer pass.

Figure 6:
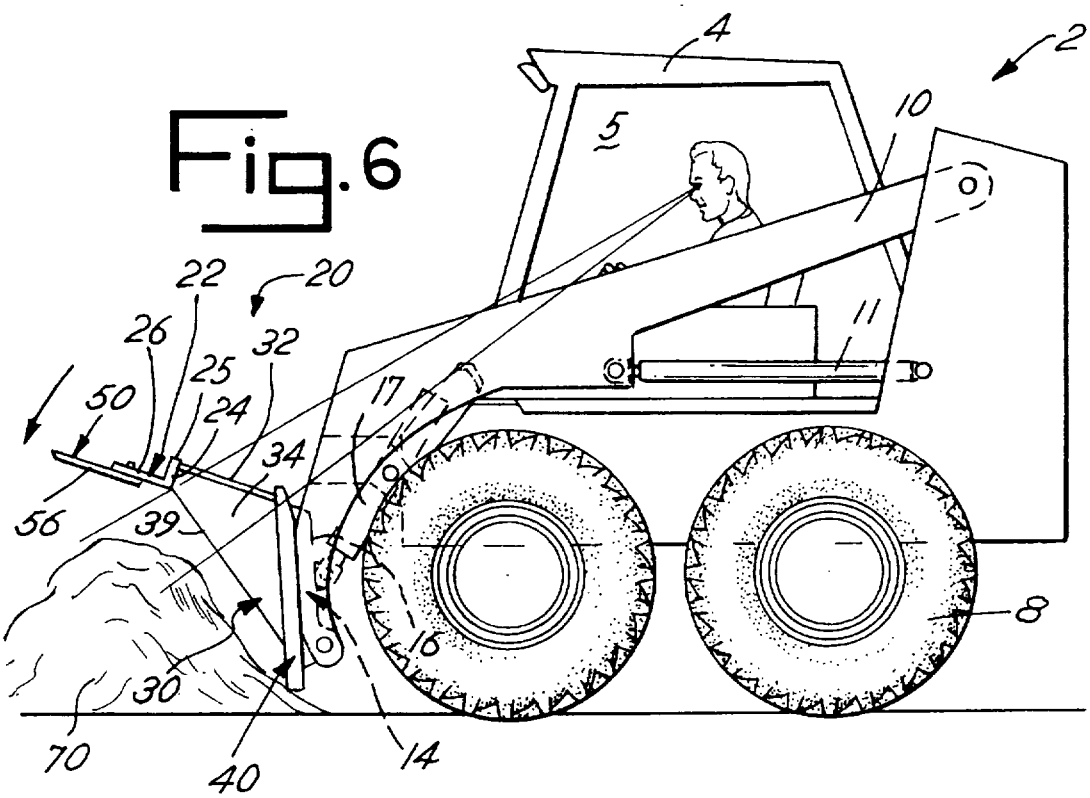
FIG. 6 is a side elevation view of the skid steer with the rake attachment grading soil in a push/pull position.

FIGS. 6 and 7 show the skid steer 2 with rake attachment in an intermediate or push/pull position. Again as seen in FIGS. 6 and 7, the design of rake attachment 20 provides the operator with a clear view of the approximate area of ground being worked. The soil can be viewed over the top of rake attachment 20, around side support members 30, or through central opening 31. In the push/pull position, mounting plate 16 is pivoted between its up and down positions, wherein lower diagonal edges 39 of side gussets 34 are approximately horizontal and parallel with the ground. In the push/pull position, rake blade 50 engages the ground at an acute angle, approximately at a 30 degree angle. The angle at which the rake blade engages the ground can be adjusted by further lowering mounting plate 16. As pivot plate 16 rotates past the rake blade's contact point with the ground, lift arms 10 are slightly raised from their lowered position to place the weight of the arms on teeth 56.

In the push/pull position, rake attachment 20 can be used to grade soil by pushing rake blade 50 forward or to drag soil by pulling soil backward. As shown in FIG. 6, forward movement of skid steer 2 pushes teeth 56 across the top layer of soil, which turns up a volume of soil along the way. The loosened soil gathers above rake blade 50 and in front of forward support member 22 as skid steer 2 moves forward. Forward support back 31 prevents the soil from moving over the top of the rake support, and does not obstruct the operators view of the ground being worked or rake blade 50. Rocks embedded in the soil are drawn up and accumulate on the top of forward support member 22. The contour, spacing and rigidity of teeth 56 allow rocks to be dislodged from the soil, but not lodged between teeth 56. Conventional rakes use coils chisels or tines, which flex under the friction of the skid steer movement, allowing rocks to lodge in between the chisels and tines. Adjusting the angle at which rake blade 50 engages the ground varies the amount of soil graded with each pass.

FIG. 7 shows soil dragged behind rake attachment 20 as skid steer 2 moves backward. As skid steer 2 moves backward, a small volume of soil is pulled backward by the under side of rake blade 50 and forward support member 22. The spacing between teeth 56 allows small amounts of loose soil to pass through, which gives a raked soil appearance. Increasing or decreasing the angle of pivot plate 16 increases or decreases the attitude of rake attachment 20 to vary the amount of soil dragged.

Referring now to the alternate embodiment of FIGS. 8–12, elements the same or substantially the same as those in the embodiment of FIGS. 1–7 retain the same reference character, but increased by 100. Referring now to FIGS. 8–12, a plurality of tubular sockets indicated by the numeral 160 are spaced evenly along the back 24 of support plate 122. Each of the sockets 160 define a vertically extending opening 162 which slidingly receives a scarifying tooth 164. Each of the scarifying teeth are substantially rectangular bars having a tapering ground penetrating end 166 which joins with side edge 168 at corner 170. As will be discussed hereinafter, the tapering end 166 and edge 170 permit the scarifying teeth 164 to chisel into hard ground to facilitate scarifying. Each of the teeth 164 is provided with an aperture which registers with apertures 174, 176 on the opposite sides of each of the sockets 160. A retaining pin 178 is inserted through the apertures 174, 176 and through the aperture in the corresponding tooth 164 to retain the corresponding scarifying tooth 164 in its corresponding socket 160. The retaining pin 178 is maintained in its position by a linch pin 180 which is received within an aperture 182. A ring 184 extends through an opening in the linch pin and is freely movable with respect thereto. Ring 184 is attached to another ring 186 on the other end of the pin 178 by a chain 188. Accordingly, each tooth 164 is installed in its corresponding socket 160 by inserting the pin 178 through apertures 174, 176, and through the corresponding tooth 164. The linch pin 180 is then installed in the aperture 182 with the ring 184 deflected out of the way. When the ring 184 is released, it sags to a point that prevents the linch pin 180 from vibrating out of the aperture 182. A washer 190 is installed on the other end of the pin to prevent the pin from being inserted into the apertures 172, 174, 176 so far that the socket 160 interferes with the ring 186.

Figure 10:
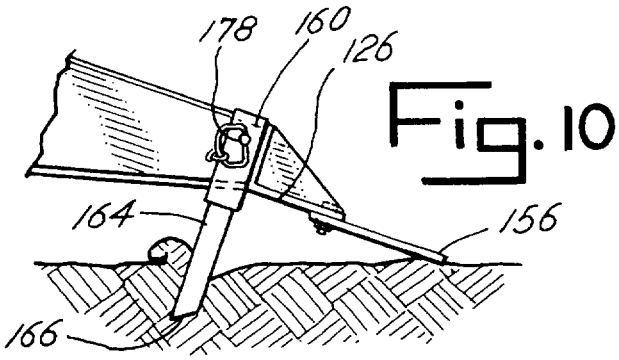
FIG. 10 is a fragmentary side elevational view of the rake according to FIGS. 8 and 9 illustrated in its ground engaging and scarifying position.
Figure 11:
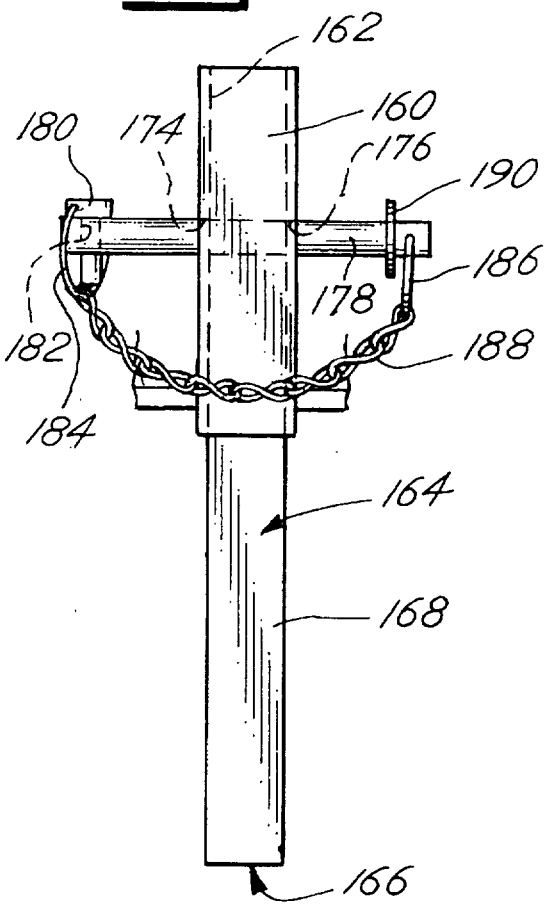
FIG. 11 is an enlarged view of the circumscribed portion of FIG. 9.
Figure 12:
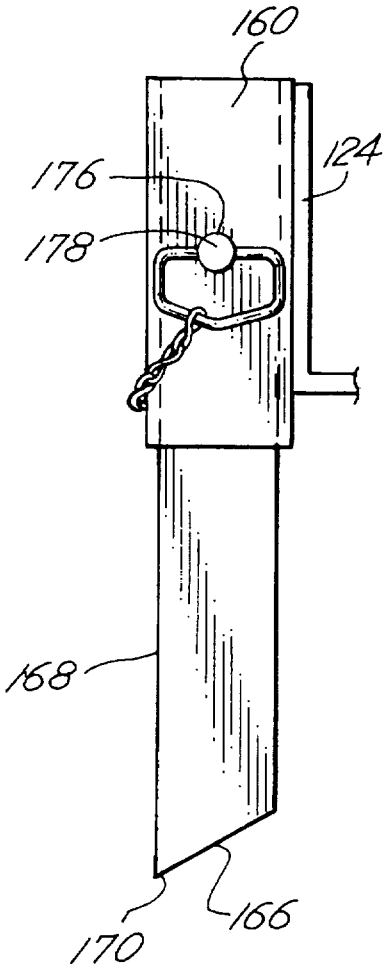
FIG. 12 is a fragmentary side view of the scarifying tooth and attachment mechanism illustrated in FIG. 11.

In operation, the scarifying teeth penetrate the ground when the support member 122 is disposed at any ground working angle, such as that illustrated in FIG. 10. Each of the teeth 164 are rectangular bars of substantial thickness and thus, because of beveled edge 160, are able to chisel into the ground and scarify the ground during both forward and backward movements of the skid steer. As the teeth 164 are scarifying the ground, the tines 156 smooth and work the ground as it is being scarified. If scarifying is not desired, the teeth 164 may be removed from the fork member 122 by removing the linch pin 180 of each tooth and then removing retaining pin 178. The teeth 164 can then be removed from their sockets 160, and are then conveniently stored on pins 192 which project from lower support braces 194 which are a part of side support members 130 and extend between back 124 and lower cross bar 196 which interconnects the side support members 130 and also extends between the connection plates 144.

Scarifying can also be accomplished with the scarifying teeth 164 removed by moving the rake to the scarifying position illustrated in FIG. 7 to use the tines 156 for scarifying, but the tines 156 are unable to penetrate the ground to the same depth as do the scarifying teeth 164 and obviously the tines 156 are not then available to level and work the soil as it is scarified.

I claim:

1. A tool, said tool being adapted for use with a skid steer for working soil, said skid steer including a frame chassis defining an operator compartment, a pair of lift arms, first pivot means pivotally connecting said lift arms to said chassis, a mounting plate, second pivot means pivotally connecting said mounting plate to said arms, and power means for pivoting said mounting plate about said second pivot means, said tool comprising a support member, mounting means connecting one end of said support member to said mounting plate, and a tined member connected to the other end of said support member and having tines for contacting soil, said mounting plate being pivotable into a position disposing said tines at an acute angle with respect to ground, said acute angle being adjustable by pivoting said mounting plate about said second pivot means, to permit soil to be graded and dragged as the skid steer is moved in both forward and reverse directions, and a set of spaced scarifying teeth extending from said support member at one direction with respect to the support member, said tines extending from said support member in a direction other than said one direction.

2. A tool as claimed in claim 1, wherein said support frame and said support member extend transversely across said arms and said scarifying teeth extend from said support member at a ground penetrating angle with respect to the support plate when the arms dispose the support frame at a ground working angle.

3. A tool as claimed in claim 1, wherein the angle between the tines and the scarifying teeth is substantially a right angle.

4. A tool as claimed in claim 1, wherein the angle at which the tines extend from the support member permits the tines to engage the ground at an oblique angle when the support frame is disposed at the ground working angle at which the scarifying teeth penetrate the ground whereby the tines smooth and work the ground scarified by said scarifying teeth.

5. A tool as claimed in claim 1, wherein the support frame includes releasable securing means for releasably securing said scarifying teeth to the support frame to permit removal of the scarifying teeth from the support frame when scarifying is not desired.

6. A tool as claimed in claim 5, wherein said relesably securing means includes tubular sockets carried on said support frame for each of the scarifying teeth, each of said scarifying teeth being received within a corresponding socket when the teeth are attached to the support member, and means for retaining the scarifying teeth in their corresponding sockets.

7. A tool as claimed in claim 6, wherein each of said sockets is defined by a wall, said retaining means including a pin extending through apertures in the walls of the socket and through an aperture in the corresponding scarifying tooth registering with the apertures in the walls of the socket.

8. A tool as claimed in claim 7, wherein said retaining means includes a releasable locking device for retaining the pin.

9. A tool as claimed in claim 7, wherein each of the scarifying teeth are substantially rectangular bars having a ground penetrating end and an opposite end, said opposite end being received within the corresponding socket.

10. A tool as claimed in claim 1, wherein each of the scarifying teeth are substantially rectangular bars having a tapering ground penetrating end to permit the scarifying teeth to chisel into the ground.

* * * * *